US010697468B2

(12) United States Patent
Matsueda

(10) Patent No.: US 10,697,468 B2
(45) Date of Patent: Jun. 30, 2020

(54) CASING ASSEMBLY AND ROTARY MACHINE

(71) Applicant: MITSUBISHI HEAVY INDUSTRIES COMPRESSOR CORPORATION, Tokyo (JP)

(72) Inventor: Takanori Matsueda, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 240 days.

(21) Appl. No.: 15/781,660

(22) PCT Filed: Dec. 7, 2015

(86) PCT No.: PCT/JP2015/084294

§ 371 (c)(1),
(2) Date: Jun. 5, 2018

(87) PCT Pub. No.: WO2017/098556

PCT Pub. Date: Jun. 15, 2017

(65) Prior Publication Data

US 2018/0347583 A1 Dec. 6, 2018

(51) Int. Cl.
*F04D 29/42* (2006.01)
*F04D 17/12* (2006.01)
(Continued)

(52) U.S. Cl.
CPC ..... *F04D 29/4226* (2013.01); *F04D 17/122* (2013.01); *F04D 29/083* (2013.01);
(Continued)

(58) Field of Classification Search
CPC .. F04D 29/42; F04D 29/4206; F04D 29/4215; F04D 17/122; F04D 17/125;
(Continued)

(56) References Cited

U.S. PATENT DOCUMENTS

2015/0345503 A1 12/2015 Del Vescovo et al.

FOREIGN PATENT DOCUMENTS

JP S62-133999 U 8/1987
JP 2001-254697 A 9/2001
(Continued)

OTHER PUBLICATIONS

International Search Report for corresponding International Application No. PCT/JP2015/084294, dated Mar. 8, 2016 (2 pages).
(Continued)

*Primary Examiner* — Justin D Seabe
*Assistant Examiner* — Jesse M Prager
(74) *Attorney, Agent, or Firm* — Osha Liang LLP

(57) ABSTRACT

A casing assembly, into which a rotor rotatable around an axis is inserted, includes: a lower half casing including a lower half flange surface and a lower half accommodation recessed portion; an upper half casing including an upper half flange surface and an upper half accommodation recessed portion; a fixing portion that fixes the lower half casing and the upper half casing to each other such that, when the lower and the upper half flange surfaces make contact, the lower half accommodation recessed portion and the upper half accommodation recessed portion form an accommodation space extending about the axis; a housing disposed in the accommodation space; and a seal member disposed on an outer peripheral surface of the housing and in contact with an inner peripheral surface of the lower half accommodation recessed portion and an inner peripheral surface of the upper half accommodation recessed portion.

4 Claims, 5 Drawing Sheets

(51) Int. Cl.
*F04D 29/62* (2006.01)
*F04D 29/08* (2006.01)
*F04D 29/12* (2006.01)

(52) U.S. Cl.
CPC ..... *F04D 29/122* (2013.01); *F04D 29/42* (2013.01); *F04D 29/4206* (2013.01); *F04D 29/624* (2013.01); *F05B 2220/40* (2013.01); *F05B 2240/14* (2013.01); *F05B 2240/57* (2013.01); *F05B 2260/301* (2013.01)

(58) Field of Classification Search
CPC .. F04D 29/083; F04D 29/122; F04D 29/4226; F04D 29/624; F05B 2220/40; F05B 2240/14; F05B 2240/57; F05B 2260/301
See application file for complete search history.

(56) References Cited

FOREIGN PATENT DOCUMENTS

| | | | |
|---|---|---|---|
| JP | 2005-171783 | A | 6/2005 |
| JP | 2013-249771 | A | 12/2013 |

OTHER PUBLICATIONS

Written Opinion for corresponding International Application No. PCT/JP2015/084294, dated Mar. 8, 2016 (10 pages).

CASING ASSEMBLY AND ROTARY MACHINE

TECHNICAL FIELD

The present invention relates to a casing assembly and a rotary machine.

BACKGROUND ART

In a centrifugal compressor, a gas is extracted in a radial direction of a rotating impeller and the gas is compressed by a centrifugal force generated when the gas is extracted. As the centrifugal compressor, a multi-stage centrifugal compressor is known, in which impellers are provided in multiple stages in the axial direction and a gas is compressed stepwise.

In the centrifugal compressor, there is a structure having a casing which can be divided by a division surface spreading in a horizontal direction. The casing is configured of an upper half casing and a lower half casing. The upper half casing is placed on the lower half casing installed on a floor surface so as to be fastened by a bolt or the like, and thus, the casing is configured. In the centrifugal compressor, a rotor is disposed to penetrate the casing. The rotor is rotatable with respect to the casing.

For example, Patent Document 1 discloses a casing which can be divided in a vertical direction. In this casing, a gap between flange bolts fastening and fixing a first casing which is an upper half casing and a second casing which is a lower half casing is adjusted. Accordingly, leakage of a high-pressure gas from division surfaces of the first casing and the second casing is suppressed.

In the above-described casing, both ends in the axial direction are opened such that the rotor is inserted into the casing. In the opening portions, a seal device such as a labyrinth seal which seals between the opening portions and the rotor is provided. The seal device is attached to a housing, and thus, the seal device is indirectly fixed to the casing. Accordingly, a seal member such as an O ring is also provided on an outer peripheral surface of the housing in order to suppress leakage of a working fluid from a portion between the outer peripheral surface and the upper half casing and a portion between the outer peripheral surface and the lower half casing.

CITATION LIST

Patent Literature

[Patent Document 1] Japanese Unexamined Patent Application, First Publication No. 2013-249771

However, even when the seal member is provided, the working fluid may leak from the portion between the outer peripheral surface of the housing and the upper half casing and the portion between the outer peripheral surface and the lower half casing. Accordingly, there is a demand to suppress the leakage of the fluid from the portion between the outer peripheral surface of the housing and the upper half casing and the portion between the outer peripheral surface and the lower half casing, with high accuracy.

SUMMARY OF INVENTION

One or more embodiments of the present invention provide a casing assembly and a rotary machine capable of suppressing the leakage of the fluid from the portion between the outer peripheral surface of the housing and the upper half casing and the portion between the outer peripheral surface and the lower half casing, with high accuracy.

According to one or more embodiments of a first aspect of the present invention, there is provided a casing assembly into which a rotor rotatable around an axis is inserted, including: a lower half casing which includes a lower half flange surface which is a horizontal surface facing upward in a vertical direction and a lower half accommodation recessed portion which is recessed downward in the vertical direction from the lower half flange surface; an upper half casing which includes an upper half flange surface which is able to contact the lower half flange surface and an upper half accommodation recessed portion which is recessed upward from the lower half flange surface; a fixing portion which is configured to fix the lower half casing and the upper half casing to each other so as to form an accommodation space extending about the axis by the lower half accommodation recessed portion and the upper half accommodation recessed portion in a state where the lower half flange surface and the upper half flange surface contact each other; a housing which is disposed in the accommodation space; and a seal member which is provided on an outer peripheral surface of the housing and is in contact with an inner peripheral surface of the lower half accommodation recessed portion and an inner peripheral surface of the upper half accommodation recessed portion, in which the lower half accommodation recessed portion includes a lower half large-diameter recessed portion which extends in an axial direction in which the axis extends, a lower half small-diameter recessed portion which is adjacent to the lower half large-diameter recessed portion in the axial direction and is formed to be smaller than the lower half large-diameter recessed portion in terms of a size in a radial direction intersecting the axis, and a lower half step surface which is formed between the lower half large-diameter recessed portion and the lower half small-diameter recessed portion and spreads in the radial direction, the upper half accommodation recessed portion includes an upper half large-diameter recessed portion which extends in the axial direction, an upper half small-diameter recessed portion which is adjacent to the upper half large-diameter recessed portion in the axial direction and is formed to be smaller than the upper half large-diameter recessed portion in terms of a size in the radial direction, and an upper half step surface which is formed between the upper half large-diameter recessed portion and the upper half small-diameter recessed portion and spreads in the radial direction, and at least one of a lower half inclined surface which is formed between the lower half flange surface and the lower half step surface and is inclined downward from the lower half flange surface toward the lower half step surface and an upper half inclined surface which is formed between the upper half flange surface and the upper half step surface and is inclined upward from the upper half flange surface toward the upper half step surface is provided.

According to one or more embodiments of this configuration, even when the lower half casing and the upper half casing fall down and are deformed inward, it is possible to avoid the upper half flange surface or the lower half flange surface by the lower half inclined surface or the upper half inclined surface. As a result, in the lower half flange surface or the upper half flange surface, a position where strong abutment is generated can be shifted from a portion facing the lower half accommodation recessed portion or the upper half accommodation recessed portion. Accordingly, it is possible to cause the lower half flange surface and the upper half flange surface to come into contact with each other around the seal member to be shifted from a location which is positioned near the seal member and at which high contact stress occurs. Therefore, it is possible to suppress a gap from being generated around the seal member, with high accuracy.

In the casing assembly according to one or more embodiments of a second aspect of the present invention, in the first aspect, only the lower half inclined surface of the lower half inclined surface and the upper half inclined surface may be provided.

According to one or more embodiments of this configuration, it is possible to suppress a gap from being generated around the seal member by machining only the lower half casing which is more easily machined than the upper half casing.

In the casing assembly according to one or more embodiments of a third aspect of the present invention, in the first or second aspect, when viewed from above in the vertical direction, the lower half large-diameter recessed portion may have a corner region on a side adjacent to the lower half small-diameter recessed portion in the axial direction and outside the lower half small-diameter recessed portion in the radial direction, and when viewed from above in the vertical direction, the lower half inclined surface is formed closer to the lower half large-diameter recessed portion than an imaginary line which connects an outermost point on a side closest to the lower half small-diameter recessed portion in the axial direction in the corner region and a contact point of an inner peripheral surface of the lower half small-diameter recessed portion with which the seal member is in contact, to each other.

According to one or more embodiments of this configuration, it is possible to form a boundary between the lower half inclined surface and the lower half flange surface on the lower half large-diameter recessed portion side from the contact point at which the seal member is in contact. Accordingly, it is possible to suppress opening between the upper half flange surface and the lower half flange surface in a region in which the seal member is disposed, with higher accuracy.

According to one or more embodiments of a fourth aspect of the present invention, there is provided a rotary machine including: the casing assembly according to any one of the first to third aspects; and a rotor which is disposed in the casing assembly.

According to one or more embodiments of this configuration, it is possible to prevent leakage of a high-pressure fluid such as a working fluid flowing through the inside, with high accuracy.

According to one or more embodiments of the present invention, it is possible to suppress leakage of a fluid from a portion between the outer peripheral surface of the housing and the upper half casing and a portion between the outer peripheral surface and the lower half casing, with high accuracy.

DETAILED DESCRIPTION OF EMBODIMENTS

Hereinafter, embodiments of the present invention will be described with reference to FIGS. 1 to 5.

Figure 1:
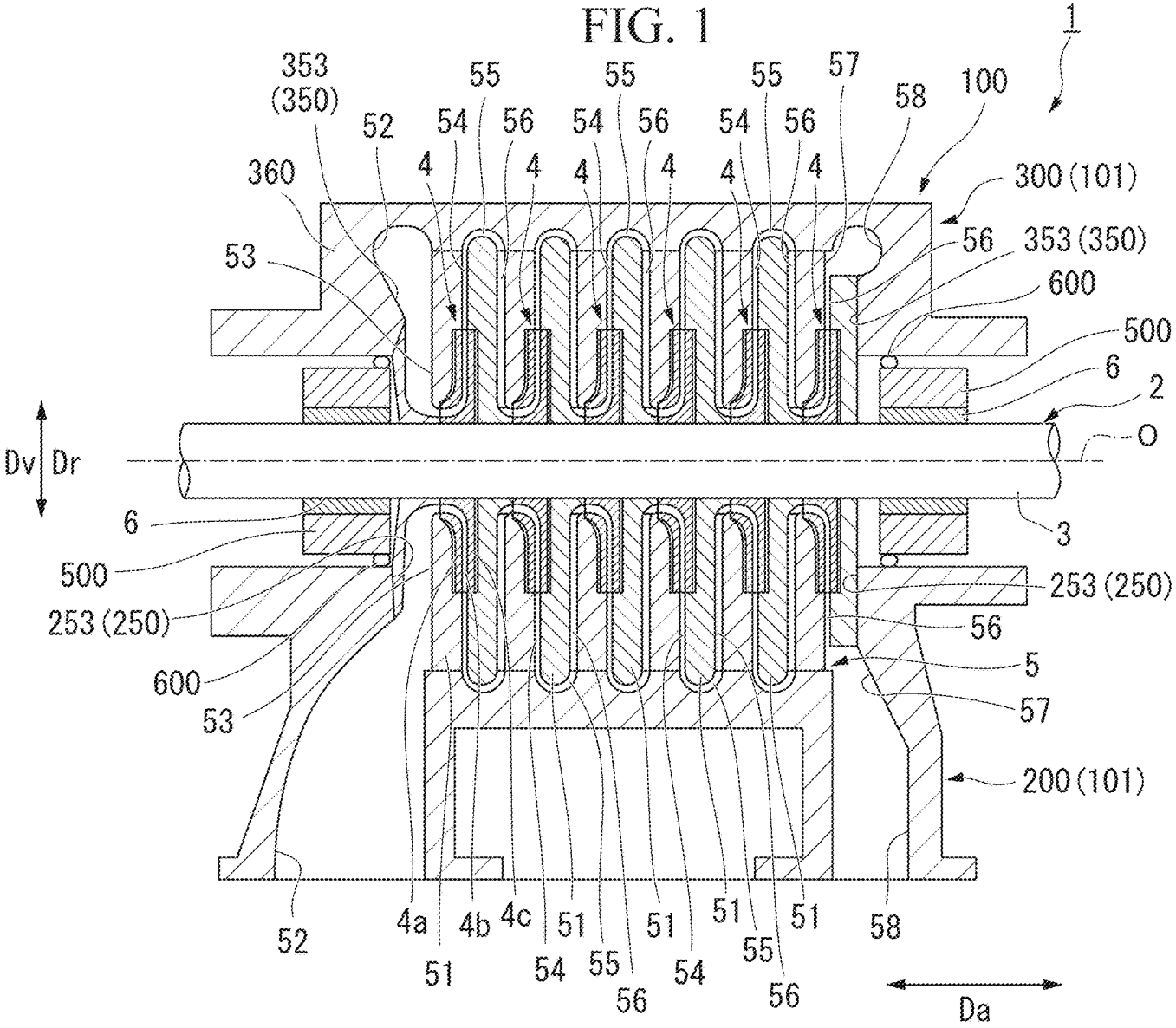
FIG. 1 is a schematic sectional view of a centrifugal compressor according to one or more embodiments of the present invention.

As shown in FIG. 1, a rotary machine of one or more embodiments includes a uniaxial multistage centrifugal compressor (multistage centrifugal compressor) 1 which includes a plurality of impellers 4.

The centrifugal compressor 1 includes a rotor 2, a diaphragm group 5, seal devices 6, and a casing assembly 100.

The rotor 2 rotates about an axis O. The rotor 2 includes a rotor body (rotating shaft) 3 which extends along the axis O and a plurality of impellers 4 which rotate together with the rotor body 3.

A driving machine (not shown) such as a motor is connected to the rotor body 3. The rotor body 3 is rotationally driven by the driving machine. The rotor body 3 is formed in a columnar shape about the axis O and extends in an axial direction Da in which the axis O extends. Both ends of the rotor body 3 in the axial direction Da are rotatably supported by a bearing (not shown).

The impellers 4 are fixed to an outer peripheral surface of the rotor body 3. The impellers 4 rotate together with the rotor body 3, and thus, the impellers 4 compress a process gas (working fluid) using a centrifugal force. A plurality of stages of impellers 4 are provided in the axial direction Da with respect to the rotor body 3. The impellers 4 of one or more embodiments are provided between the bearings disposed on both sides in the axial direction Da with respect to the rotor body 3. Each of the impellers 4 is a so-called closed type impeller which includes a disk 4*c*, a blade 4*b*, and a cover 4*a*. A flow path through which the process gas flows is defined by the disks 4*c*, the blades 4*b*, and the covers 4*a* of the impellers 4. An impeller group is configured by the plurality of impellers 4 arranged in the same direction along the axial direction Da. The centrifugal compressor 1 of one or more embodiments has one impeller group.

The diaphragm group 5 covers the rotor 2 from the outside. The diaphragm group 5 is configured of a plurality of diaphragms 51 arranged in the axial direction Da respectively corresponding to the plurality of stages of impellers 4. The plurality of diaphragms 51 are arranged to laminated in the axial direction Da. In each diaphragm 51, a space which can accommodate each impeller 4 is formed on the inside in a radial direction Dr of the rotor body 3 which is a direction intersecting the axis O. The diaphragms 51 are connected to each other, and thus, define the flow path through which the process gas flows, together with the flow path of the impellers 4.

Here, specifically, the flow path formed by the diaphragms 51 is described in order from an upstream side, which is one side in the axial direction Da. In one or more embodiments, the diaphragm group 5 defines, in order from the upstream side from which the process gas flows, a suction port 52, a suction flow path 53, a plurality of diffuser flow paths 54, a plurality of curved flow paths 55, a plurality of return flow paths 56, a discharge flow path 57, and a discharge port 58.

The process gas flows into the suction flow path 53 through the suction port 52 from the outside. The process gas which has flowed in from the outside of a casing 101 described later flows to the inside of the diaphragm group 5 through the suction port 52. The suction port 52 is connected to the suction flow path 53 while a flow path area of the suction port 52 gradually decreases from the outside in the radial direction Dr toward the inside in the radial direction Dr.

The process gas flows from the outside into the impeller 4 disposed on the most upstream side in the plurality of impellers 4 arranged in the axial direction Da through the suction port 52 and the suction flow path 53. The suction flow path 53 extends to the inside in the radial direction Dr from the suction port 52. The suction flow path 53 is connected to an inlet of the impeller 4 facing the upstream side while a direction of the suction flow path 53 is changed from the radial direction Dr toward a downstream side, which is the other side in the axial direction Da.

The process gas which has flowed from the impellers 4 to the outside in the radial direction Dr flows into the diffuser flow paths 54. The diffuser flow paths 54 are connected to outlets of the impellers 4 facing the outside in the radial direction Dr. The diffuser flow paths 54 extend from the outlets of the impellers 4 toward the outside in the radial direction Dr and are connected to the curved flow paths 55.

A flow direction of the process gas is converted from the direction toward the outside in the radial direction Dr to the direction toward the inside in the radial direction Dr by the curved flow paths 55. That is, when viewed in the radial direction Dr, each of the curved flow paths 55 is a flow path having a U shape. The curved flow paths 55 are formed between an outer peripheral surface of the diaphragm group 5 and an inner peripheral surface of the casing 101.

The process gas which has flowed through the curved flow paths 55 flows into the impellers 4 through the return flow paths 56. A flow path width of each of the return flow paths 56 gradually increases while the flow return flow path extends toward the inside in the radial direction Dr. The flow direction of the process gas is changed toward the downstream side in the axial direction Da on the inside at the diaphragm group 5 in the radial direction Dr by the return flow paths 56.

The seal devices 6 prevent the process gas from leaking from the inside of the casing 101 to the outside thereof. Each of the seal devices 6 seals the entire periphery of the outer peripheral surface of the rotor body 3. For example, as the seal device 6 of one or more embodiments, a labyrinth seal is used.

The rotor 2, the diaphragm group 5, and the seal devices 6 are accommodated inside the casing assembly 100. The casing assembly 100 includes a lower half casing 200, an upper half casing 300, a fixing portion 400, housings 500, and seal members 600.

The lower half casing 200 is fixed to a floor surface. In the lower half casing 200, a portion of the suction port 52 is formed so as to open downward in a vertical direction Dv. In the lower half casing 200, a portion of the discharge port 58 is formed so as to open downward in the vertical direction Dv. The casing 101 is formed by combining the lower half casing 200 with the upper half casing 300.

The casing 101 forms an exterior of the centrifugal compressor 1. The casing 101 is formed in a cylindrical shape. The casing 101 is formed such that a center axis of the casing 101 coincides with the axis O of the rotor body 3. The diaphragm group 5 is accommodated inside the casing 101.

Figure 2:
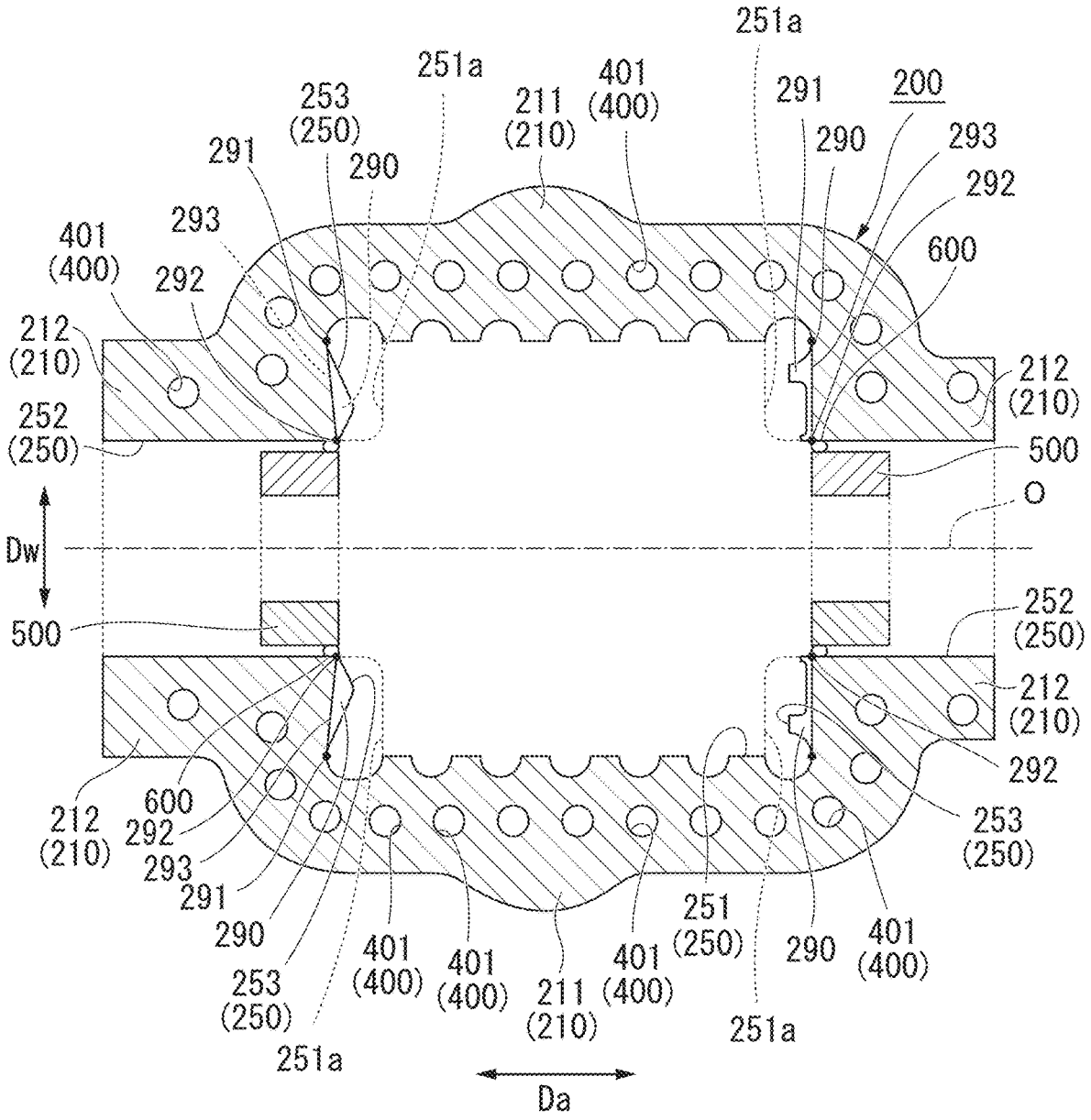
FIG. 2 is a view of a lower half casing in one or more embodiments of the present invention when viewed from above in a vertical direction.

The lower half casing 200 is open upward in the vertical direction Dv. As shown in FIG. 2, the lower half casing 200 includes lower half flange surfaces 210, lower half accommodation recessed portions 250, and lower half inclined surfaces 290.

Each of the lower half flange surfaces 210 is a horizontal surface facing upward in the vertical direction Dv. The lower half flange surface 210 is one division surface when the casing 101 is divided into an upper portion and a lower portion in the vertical direction Dv. A plurality of fixing holes 401 to which fastening bolts described later are screwed are formed in the lower half flange surface 210. Each of the fixing holes 401 is recessed downward in the vertical direction Dv from the lower half flange surface 210. The plurality of fixing holes 401 are formed at intervals along a direction in which each of the lower half flange surfaces 210 extends. Each of the lower half flange surfaces 210 includes a first lower half flange surface 211 and second lower half flange surfaces 212.

The first lower half flange surface 211 is connected to a lower half large-diameter recessed portion 251 described later of the lower half accommodation recessed portion 250. Two first lower half flange surfaces 211 are formed to be separated from each other in the width direction Dw in a state where the axis O is interposed therebetween when viewed from above in the vertical direction Dv. Each of the first lower half flange surfaces 211 is a flat surface extending the longest in the axial direction Da. In addition, the width direction Dw is a direction parallel to a horizontal surface orthogonal to the vertical direction Dv and the axial direction Da in the radial direction Dr.

Each of the second lower half flange surfaces 212 is connected to a lower half small-diameter recessed portion 252 described later of the lower half accommodation recessed portion 250. The second lower half flange surface 212 is a flat surface which is continuous to the first lower half flange surface 211. The second lower half flange surfaces 212 are formed both sides of the first lower half flange surfaces 211 in the axial direction Da. When viewed from above in the vertical direction Dv, the second lower half flange surface 212 is disposed inside (a side close to the axis O) the first lower half flange surface 211 in the width direction Dw.

The lower half accommodation recessed portion 250 is recessed downward in the vertical direction Dv from the lower half flange surfaces 210. When viewed from above in the vertical direction Dv, the lower half accommodation recessed portion 250 is a space which is covered by an inner surface of the lower half casing 200. The lower half accommodation recessed portion 250 includes the lower half large-diameter recessed portion 251, the lower half small-diameter recessed portions 252, and lower half step surfaces 253.

The lower half large-diameter recessed portion 251 is a space in which the diaphragm group 5 is accommodated. The lower half large-diameter recessed portion 251 extends in the axial direction Da. The lower half large-diameter recessed portion 251 is formed to be recessed from the first lower half flange surfaces 211. The lower half large-diameter recessed portion 251 is a space which is formed about the axis O. When viewed from above in the vertical direction Dv, the lower half large-diameter recessed portion 251 is formed inside the two first lower half flange surfaces 211 in the width direction Dw to be interposed therebetween. When viewed from above in the vertical direction Dv, the lower half large-diameter recessed portion 251 is formed in an approximately rectangular shape. The lower half large-diameter recessed portion 251 forms a portion of the curved flow paths 55 by an inner surface of the lower half casing 200 facing the inside in the width direction Dw. When viewed from above in the vertical direction Dv, the lower half large-diameter recessed portion 251 includes lower half corner regions (corner region) 251*a* which are disposed on a side adjacent to the lower half small-diameter recessed portions 252 in the axial direction Da and outside (sides away from the axis O) the lower half small-diameter recessed portions 252 in the width direction Dw.

When viewed from above in the vertical direction Dv, each of the lower half corner regions 251*a* is a space forming a corner of the lower half large-diameter recessed portion 251. The lower half corner regions 251*a* form both sides of the lower half large-diameter recessed portions 251 in the axial direction Da. That is, the lower half corner regions 251*a* is a region adjacent to the lower half step surface 253 described later and forms a portion of the suction port 52 or the discharge port 58.

Each of the lower half small-diameter recessed portions 252 is a space in which the seal device 6 is accommodated. The lower half small-diameter recessed portion 252 is adjacent to the lower half large-diameter recessed portion 251 in the axial direction Da and extends in the axial direction Da. The lower half small-diameter recessed portion 252 is a space which is connected to the lower half large-diameter recessed portion 251 in the axial direction Da. The lower half small-diameter recessed portions 252 are provided on both sides of the lower half large-diameter recessed portion 251 in the axial direction Da such that the lower half large-diameter recessed portion 251 is interposed therebetween. Each of the lower half small-diameter recessed portions 252 is formed to be recessed from the second lower half flange surfaces 212. The lower half small-diameter recessed portion 252 is a space which is formed about the axis O. When viewed from above in the vertical direction Dv, the lower half small-diameter recessed portion 252 is formed inside the two second lower half flange surfaces 212 in the width direction Dw to be interposed therebetween. The lower half small-diameter recessed portion 252 is formed to be smaller than the lower half large-diameter recessed portion 251 in terms of a size in the radial direction Dr. That is, when viewed from above in the vertical direction Dv, the lower half small-diameter recessed portion 252 is formed in a rectangular shape which is smaller than that of the lower half large-diameter recessed portion 251. Specifically, when viewed from above in the vertical direction Dv, the lower half small-diameter recessed portion 252 is formed to be smaller than the lower half large-diameter recessed portion 251 by lengths of the lower half corner regions 251*a* in the width direction Dw.

The lower half step surface 253 is a surface which is formed between the lower half large-diameter recessed portion 251 and the lower half small-diameter recessed portion 252 and spreads in the radial direction Dr. The lower half step surface 253 is a portion of the surface defining the lower half large-diameter recessed portion 251. Specifically, the lower half step surface 253 is a portion of an inner surface of the lower half casing 200 which forms the lower half large-diameter recessed portion 251 and faces the axial direction Da. The lower half step surface 253 is connected the lower half flange surface 210 via the lower half inclined surface 290. The lower half step surface 253 on one side in the axial direction Da forms a portion of the suction port 52. The lower half step surface 253 on the other side in the axial direction Da forms a portion of the discharge port 58.

The lower half inclined surface 290 is formed between the lower half flange surface 210 and the lower half step surface 253. The lower half inclined surface 290 is inclined downward in the vertical direction Dv from the lower half flange surface 210 toward the lower half step surface 253. That is, in a case where the upper half casing 300 is combined with the lower half casing 200, the lower half inclined surface 290 is formed so as not to be in contact with the upper half flange surface 310 described later. When viewed from above in the vertical direction Dv, one side of the lower half inclined surface 290 in the axial direction Da is connected to the lower half flange surface 210. When viewed from above in the vertical direction Dv, the other side of the lower half inclined surface 290 in the axial direction Da is connected to the lower half step surface 253. When viewed from above in the vertical direction Dv, the lower half inclined surface 290 is formed closer to the lower half large-diameter recessed portion 251 than an imaginary line 293 which connects an outermost point 291 on a side closest to the lower half small-diameter recessed portion 252 in the axial direction Da in the lower half corner region 251*a* and a contact point 292 of an inner peripheral surface of the lower half small-diameter recessed portion 252 with which the seal member 600 is in contact to each other. The lower half inclined surface 290 is formed closer to the lower half large-diameter recessed portion 251 than the imaginary line 293 which connects the contact point 292 closest to the lower half large-diameter recessed portion 251 in the axial direction Da of the contact points 292 of the inner peripheral surface of the lower half small-diameter recessed portion 252 with which the seal member 600 is in contact and the outermost point 291. The imaginary line 293 of one or more embodiments forms a boundary between the lower half inclined surface 290 and the lower half flange surface 210.

In addition, the lower half inclined surface 290 is not limited to the case where the imaginary line 293 is formed as the boundary as in one or more embodiments. The lower half inclined surface 290 may be formed in any shape as long as the boundary between the lower half inclined surface 290 and the lower half flange surface 210 is disposed closer to the lower half large-diameter recessed portion 251 than the imaginary line 293.

Here, the outermost point 291 is a point which is positioned on the outermost side in the lower half corner region 251*a* in the axial direction Da. That is, the outermost point 291 is a point which is positioned on the outermost side in the suction port 52 or the discharge port 58 in the axial direction Da.

Figure 3:
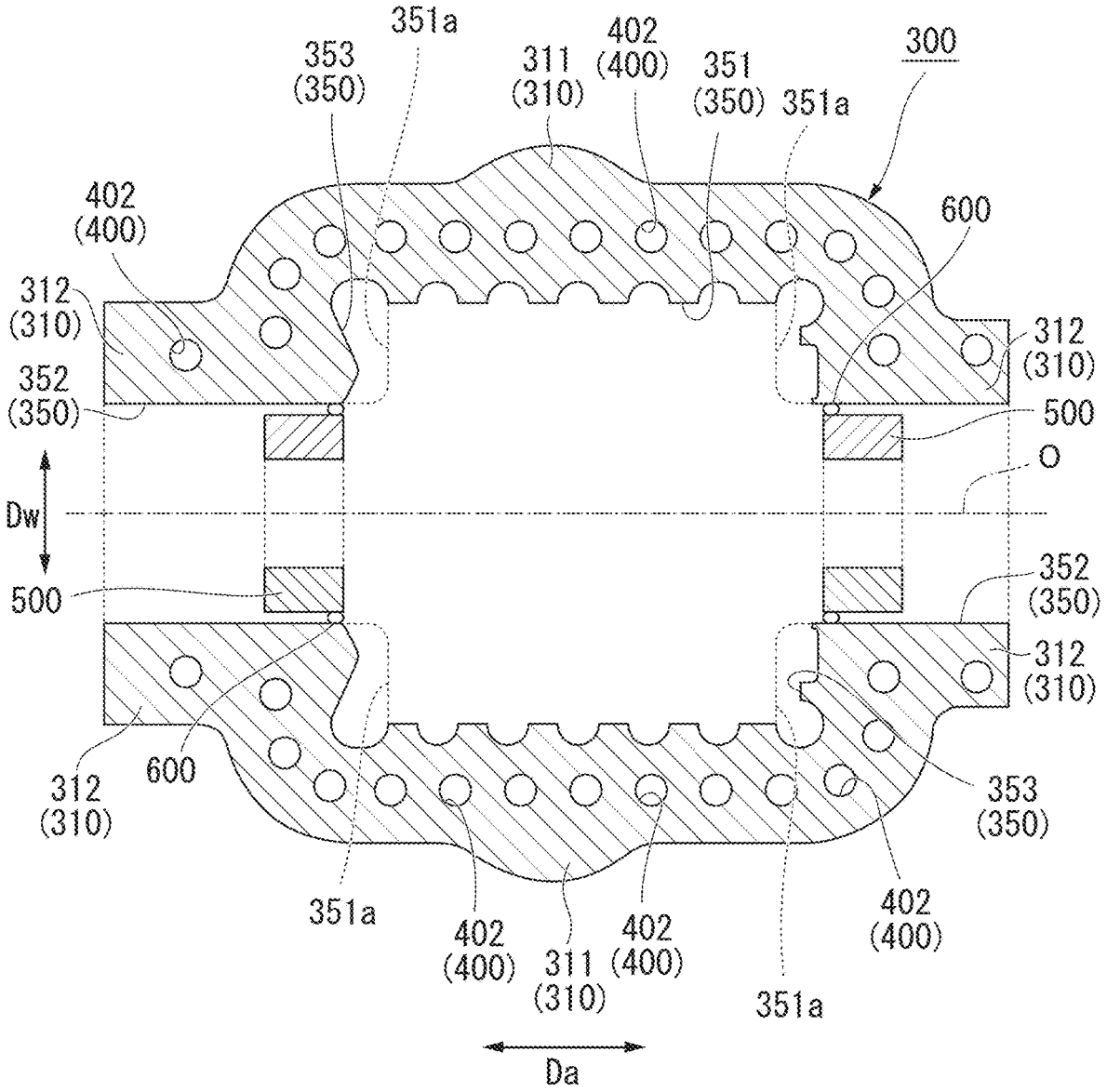
FIG. 3 is a view of an upper half casing in one or more embodiments of the present invention when viewed from below in a vertical direction.

As shown in FIG. 1, the upper half casing 300 is fixed to lower half casing 200. The upper half casing 300 is open downward in the vertical direction Dv. Unlike the lower half casing 200, a portion of the upper half casing 300 in which a portion of the suction port 52 is formed is not opened so as not to communicate with the outside. Similarly, a portion of the upper half casing 300 in which a portion of the discharge port 58 is formed is not opened so as not to communicate with the outside. The upper half casing 300 does not have upper half inclined surfaces corresponding to the lower half inclined surfaces 290, and other configurations of the upper half casing 300 are similar to those of the lower half casing 200. That is, as shown in FIG. 3, a shape of the upper half casing 300 when viewed from below in the vertical direction Dv is similarly the same as the shape of the lower half casing 200 when viewed from below in the vertical direction Dv. The upper half casing 300 includes the upper half flange surface 310 corresponding to the lower half flange surfaces 210 and an upper half accommodation recessed portion 350 corresponding to the lower half accommodation recessed portion 250.

The upper half flange surface 310 is a horizontal surface facing downward in the vertical direction Dv. The upper half flange surface 310 is the other division surface when the casing 101 is divided in the vertical direction. That is, the upper half flange surfaces 310 can contact the lower half flange surfaces 210. A plurality of through-holes 402 into which the fastening bolts are inserted are formed in the upper half flange surface 310. Each of the through-holes 402 is recessed upward in the vertical direction Dv from the upper half flange surface 310. The plurality of through-holes 402 are formed at intervals along a direction in which each of the upper half flange surfaces 310 extends. The through-holes 402 are formed to match the positions of the fixing holes 401 in a case where the upper half casing 300 is combined with the lower half casing 200. Each of the upper half flange surfaces 310 includes a first upper half flange surface 311 and second upper half flange surfaces 312.

The first upper half flange surface 311 is connected to an upper half large-diameter recessed portion 351 described later of the upper half accommodation recessed portion 350. Two first upper half flange surfaces 311 are formed to be separated from each other in the width direction Dw in a state where the axis O is interposed therebetween when viewed from above in the vertical direction Dv. Each of the first upper half flange surfaces 311 is a flat surface extending the longest in the axial direction Da. Each of the first upper half flange surfaces 311 and each of the first lower half flange surfaces 211 have the same shape as each other.

Each of the second upper half flange surfaces 312 is connected to an upper half small-diameter recessed portion 352 described later of the upper half accommodation recessed portion 350. The second upper half flange surfaces 312 are formed both sides of the first upper half flange surfaces 311 in the axial direction Da. Each of the second upper half flange surfaces 312 is a flat surface which is continuous to the first upper half flange surface 311. When viewed from above in the vertical direction Dv, the second upper half flange surface 312 is disposed inside (a side close to the axis O) the first upper half flange surface 311 in the width direction Dw. Each of the second upper half flange surface 312 and each of the second lower half flange surfaces 212 have the same shape as each other.

The upper half accommodation recessed portion 350 is recessed upward in the vertical direction Dv from the upper half flange surfaces 310. When viewed from below in the vertical direction Dv, the upper half accommodation recessed portion 350 is a space which is covered by an inner surface of the upper half casing 300. In a case where the upper half casing 300 and the lower half casing 200 are combined with each other, the upper half accommodation recessed portion 350 is disposed above the lower half accommodation recessed portion 250 in the vertical direction Dv. An accommodation space extending about the axis O is formed inside the casing 101 by the lower half accommodation recessed portion 250 and the upper half accommodation recessed portion 350. A member such as the diaphragm group 5, the seal devices 6, or the like is disposed in the accommodation space. The upper half accommodation recessed portion 350 includes the upper half large-diameter recessed portion 351, the upper half small-diameter recessed portions 352, and upper half step surfaces 353.

The upper half large-diameter recessed portion 351 and the lower half large-diameter recessed portion 251 are a space in which the diaphragm group 5 is accommodated. The upper half large-diameter recessed portion 351 extends in the axial direction Da. The upper half large-diameter recessed portion 351 is formed to be recessed from the first upper half flange surfaces 311. The upper half large-diameter recessed portion 351 is a space which is formed about the axis O. When viewed from below in the vertical direction Dv, the upper half large-diameter recessed portion 351 is formed inside the two first upper half flange surfaces 311 in the width direction Dw to be interposed therebetween. When viewed from below in the vertical direction Dv, the upper half large-diameter recessed portion 351 is formed in an approximately rectangular shape. The upper half large-diameter recessed portion 351 forms a portion of the curved flow paths 55 by an inner surface of the upper half casing 300 facing the inside in the width direction Dw. When viewed from below in the vertical direction Dv, the upper half large-diameter recessed portion 351 includes upper half corner regions 351*a* which are disposed on a side adjacent to the upper half small-diameter recessed portions 352 in the axial direction Da and outside the upper half small-diameter recessed portions 352 in the width direction Dw.

When viewed from below in the vertical direction Dv, each of the upper half corner regions 351*a* is a space forming a corner of the upper half large-diameter recessed portion 351. The upper half corner regions 351*a* are form both sides of the upper half large-diameter recessed portions 351 in the axial direction Da. That is, the upper half corner region 351*a* is a region adjacent to the upper half step surface 353 described later and forms a portion of the suction port 52 or the discharge port 58.

The upper half small-diameter recessed portion 352 and the lower half small-diameter recessed portion 252 are a space in which the seal device 6 is accommodated. The upper half small-diameter recessed portion 352 is adjacent to the upper half large-diameter recessed portion 351 in the axial direction Da and extends in the axial direction Da. The upper half small-diameter recessed portion 352 is a space which is connected to the upper half large-diameter recessed portion 351 in the axial direction Da. The upper half small-diameter recessed portions 352 are provided on both sides of the upper half large-diameter recessed portion 351 in the axial direction Da such that the upper half large-diameter recessed portion 351 is interposed therebetween. Each of the upper half small-diameter recessed portions 352 is formed to be recessed from the second upper half flange surfaces 312. The upper half small-diameter recessed portion 352 is a space which is formed about the axis O. When viewed from below in the vertical direction Dv, the upper half small-diameter recessed portion 352 is formed inside the two second upper half flange surfaces 312 in the width direction Dw to be interposed therebetween. The upper half small-diameter recessed portion 352 is formed to be smaller than the upper half large-diameter recessed portion 351 in terms of a size in the radial direction Dr. That is, when viewed from below in the vertical direction Dv, the upper half small-diameter recessed portion 352 is formed in a rectangular shape which is smaller than that of the upper half large-diameter recessed portion 351. Specifically, when viewed from above in the vertical direction Dv, the upper half small-diameter recessed portion 352 is formed to be smaller than the upper half large-diameter recessed portion 351 by lengths of the upper half corner regions 351*a* in the width direction Dw.

The upper half step surface 353 is a surface which is formed between the upper half large-diameter recessed portion 351 and the upper half small-diameter recessed portion 352 and spreads in the radial direction Dr. The upper half step surface 353 is a portion of the surface defining the upper half large-diameter recessed portion 351. Specifically, the upper half step surface 353 is a portion of an inner surface of the upper half casing 300 which forms the upper half large-diameter recessed portion 351 and faces the axial direction Da. The upper half step surface 353 is directly connected to the upper half flange surface 310. The upper half step surface 353 on one side in the axial direction Da forms a portion of the suction port 52. The upper half step surface 353 on the other side in the axial direction Da forms a portion of the discharge port 58. The upper half step surface 353 is a surface which is continuous to the lower half step surface 253 in a case where the upper half casing 300 and the lower half casing 200 are combined with each other.

The fixing portion 400 fixes the lower half casing 200 and the upper half casing 300 so as to form the accommodation space in a state where the lower half flange surface 210 and the upper half flange surface 310 contact each other. The fixing portion 400 of one or more embodiments includes the fixing holes 401 which are formed in the lower half flange surfaces 210, the through-holes 402 which are formed in the upper half flange surface 310, and fastening bolts (not shown) which are screwed to the fixing holes 401 in a state of being inserted into the through-holes 402.

The housings 500 are accommodated in the accommodation space. The housings 500 of one or more embodiments are accommodated in the space formed by the lower half small-diameter recessed portions 252 and the upper half small-diameter recessed portions 352 in the accommodation space. The housings 500 are respectively provided on one side and the other side of the accommodation space in the axial direction Da. The seal device 6 can be fixed to the inside of each of the housings 500. The housing 500 is formed in a cylindrical shape about the axis O. The rotor body 3 is inserted into the housing 500 in a state where the seal device 6 is fixed to the inside of the housing 500. The housing 500 is fixed to the lower half casing 200 and the upper half casing 300 via the seal member 600.

Each of the seal members 600 seals a portion between the lower half casing 200 and the housing 500 and a portion between the upper half casing 300 and the housing 500. The seal member 600 is provided on an outer peripheral surface of the housing 500. The seal member 600 is in contact with the inner peripheral surface of the lower half small-diameter recessed portion 252 and the inner peripheral surface of the upper half small-diameter recessed portion 352. The seal member 600 of one or more embodiments is an O ring. One seal member 600 is provided on an inner end portion in the axial direction Da with respect to the outer peripheral surface of the housing 500.

In the above-described centrifugal compressor 1, the upper half casing 300 is placed on the lower half casing 200 from above in the vertical direction Dv in a state where the rotor 2 and the diaphragm group 5 is placed on the lower half casing 200. In this state, the fastening bolts are inserted into the through-holes 402 and tip portions of the fastening bolts are fixed to the fixing holes 401. Accordingly, the centrifugal compressor 1 including the casing assembly 100 and the rotor 2 disposed inside the casing assembly 100 is assembled.

If the centrifugal compressor 1 is operated, a high-pressure process gas flows, and thus, a large pressure is generated in a space between the lower half large-diameter recessed portion 251 and the upper half large-diameter recessed portion 351 in which the diaphragm group 5 or the like is disposed. If the large pressure is generated, even when the seal member 600 is provided on the outer peripheral surface of the housing 500, the process gas may leak from a portion between the outer peripheral surface of the housing 500 and the lower half casing 200 or a portion between the outer peripheral surface of the housing 500 and the upper half casing 300.

This is because a portion between the lower half flange surface 210 and the upper half flange surface 310 adjacent to portions of the lower half casing 200 and the upper half casing 300 which are in contact with the seal member 600 is open. Accordingly, the process gas flows out from the portion between the lower half flange surface 210 and the upper half flange surface 310 to bypass the portion where the seal member 600 is provided.

In the lower half casing 200 and the upper half casing 300, both end portions in the axial direction Da are open such that the rotor body 3 is inserted into the lower half casing 200 and the upper half casing 300, and thus, there is no flange in both end portions, and thicknesses of both end portions are thin. In addition, in the lower half casing 200 and the upper half casing 300, a large space such as the suction port 52 or the discharge port 58 is formed on both sides in the axial direction Da. Accordingly, in the lower half casing 200 and the upper half casing 300, rigidities of both side portions in the axial direction Da are lower than those of other portions. In this state, if a high pressure is generated inside the lower half casing 200 and the upper half casing 300, a large load is applied to both sides of each of the lower half casing 200 and the upper half casing 300 in the axial direction Da. Accordingly, the lower half casing 200 and the upper half casing 300 are deformed such that the lower half flange surface 210 of the lower half casing 200 and the upper half flange surface 310 of the upper half casing 300 are inclined toward the outside in the axial direction Da.

The deformation is generated in a state where the lower half inclined surface 290 or the upper half inclined surface is not formed, and when viewed in the vertical direction Dv, a portion adjacent to the lower half large-diameter recessed portion 251 of the lower half flange surface 210 and a portion adjacent to the upper half large-diameter recessed portion 351 of the upper half flange surface 310 strongly contact each other. That is, the lower half flange surface 210 and the upper half flange surface 310 strongly contact each other on the position closer to a center side in the axial direction Da than the positions facing the portions which are in contact with the seal member 600. As a result, high contact stress is generated. And thus, the portion in which the lower half flange surface 210 and the upper half flange surface 310 strongly contact each other acts as a fulcrum and the lower half flange surface 210 and the upper half flange surface 310 is opened so as to have a space around the seal member 600.

Figure 4:
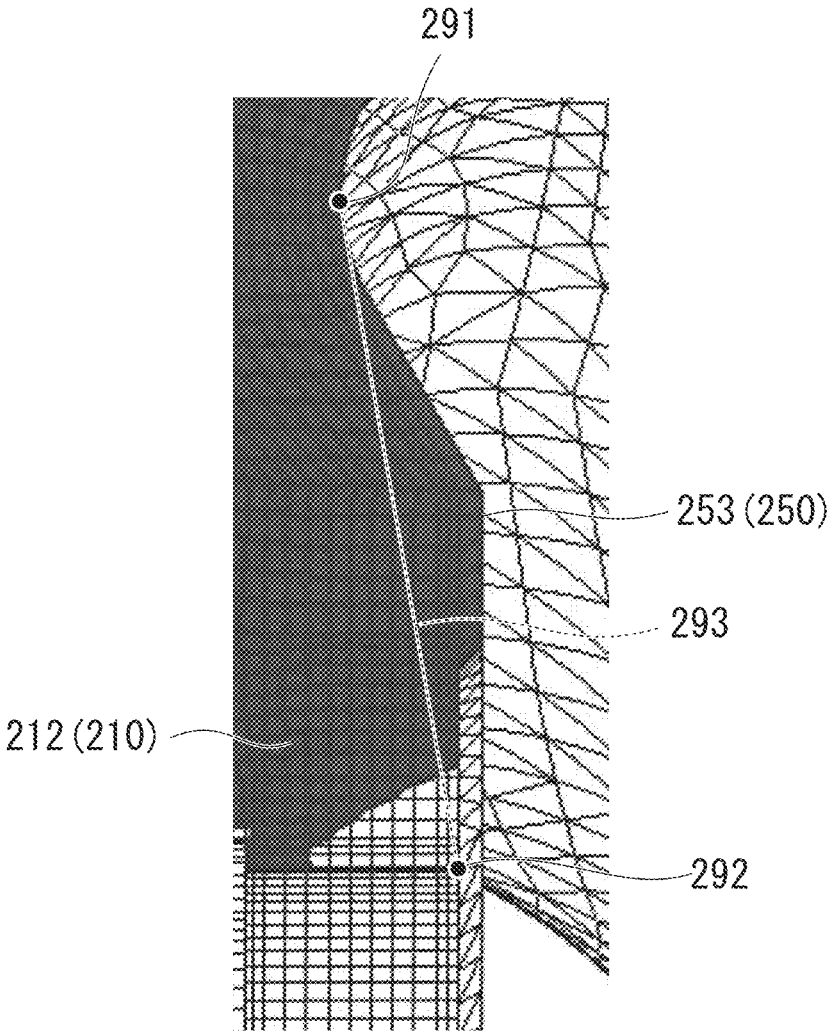
FIG. 4 is a diagram showing an analysis result, according to one or more embodiments, of a surface pressure of a portion facing a lower half large-diameter recessed portion of a lower half flange surface in a lower half casing which does not have a lower half inclined surface.

FIG. 4 shows a surface pressure distribution of the lower half flange surface 210 in the lower half casing 200 which does not have the lower half inclined surface 290 and the upper half inclined surface unlike the present invention. As shown in FIG. 4, the surface pressure is generated between the portion close to the upper half large-diameter recessed portion 351 on the upper half flange surface 310 and the portion close to the lower half large-diameter recessed portion 251 on the lower half flange surface 210, and thus, it is understood that a color in the drawing is darker. Meanwhile, in this state, the surface pressure is not generated around the contact point 292 which is the periphery of the seal member 600, and thus, there is no color in the drawing. That is, the portion of demarcation between the lower half flange surface 210 and the upper half flange surface 310 is opened, and thus, it is understood that the surface pressure is not generated in the portion. Accordingly, in this state, the process gas leaks from the portion of demarcation between the lower half flange surface 210 and the upper half flange surface 310 to bypass the seal member 600.

Meanwhile, in one or more embodiments, the lower half inclined surface 290 inclined downward in the vertical direction Dv is formed between the lower half flange surface 210 and the lower half step surface 253. Accordingly, even in a case where the lower half casing 200 and the upper half casing 300 are deformed to fall down such that the lower half flange surface 210 and the upper half flange surface 310 are inclined toward the outside in the axial direction Da, it is possible to avoid the upper half flange surface 310 by the lower half inclined surface 290. That is, it is possible to prevent the lower half inclined surface 290 and the upper half flange surface 310 from coming into contact with each other. As a result, it is possible to shift the position where strong abutment is generated and which the high contact pressure is generated in in the lower half flange surface 210 and the upper half flange surface 310, from the portion close to the lower half large-diameter recessed portion 251 or the upper half large-diameter recessed portion 351. Accordingly, it is possible to cause the lower half flange surface 210 and the upper half flange surface 310 to come into contact with each other around the seal member 600 to be shifted from the location which is positioned near the seal member 600 and at which high contact stress occurs. Therefore, it is possible to suppress a gap from being generated around the seal member 600, with high accuracy. Accordingly, it is possible to suppress leakage of the process gas from a portion between the outer peripheral surface of the housing 500 and the upper half casing 300 and a portion between the outer peripheral surface of the housing 500 and the lower half casing 200, with high accuracy.

Figure 5:
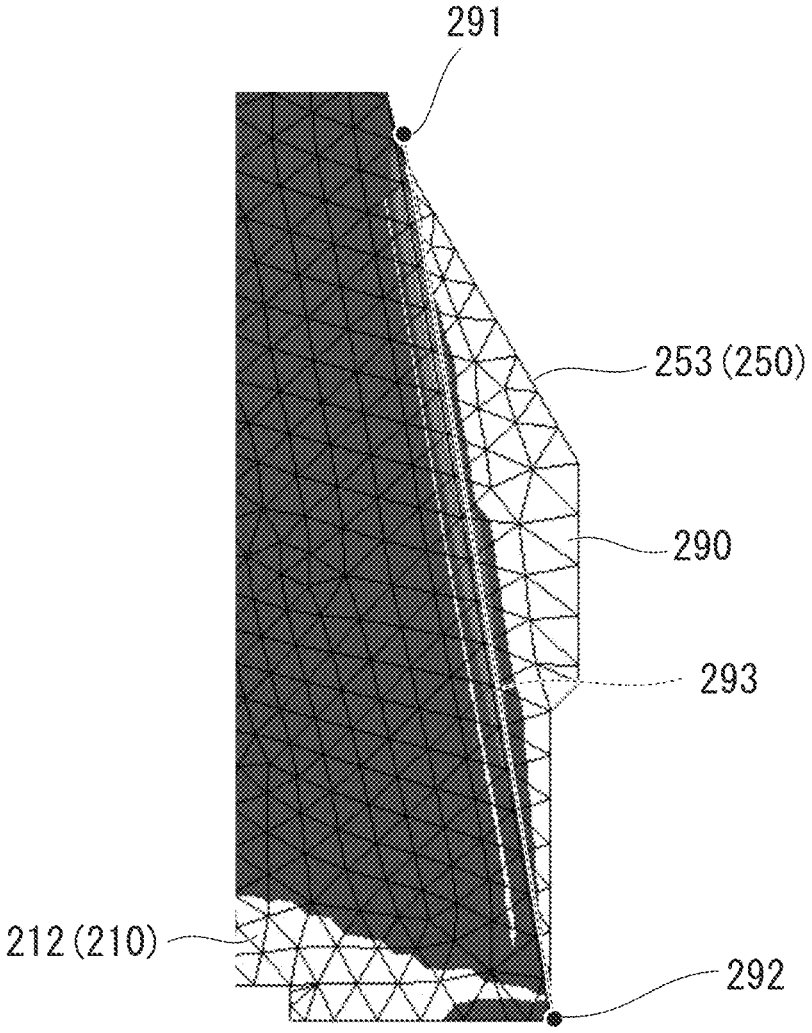
FIG. 5 is a diagram showing an analysis result of a surface pressure of a lower half inclined surface in one or more embodiments of the present invention.

Specifically, FIG. 5 shows a surface pressure distribution of the lower half flange surface 210 in the lower half casing 200 in which the lower half inclined surface 290 is formed. As shown in FIG. 5, the surface pressure is not generated in the portion close to the lower half large-diameter recessed portion 251 on the lower half inclined surface 290, and a color in the drawing is not dark. Meanwhile, the surface pressure is generated in a position close to the second lower half flange surface 212 on the lower half inclined surface 290, and the color is darker. That is, it is understood that the portion close to the lower half large-diameter recessed portion 251 on the lower half inclined surface 290 does not come into contact with the upper half flange surface 310. In addition, the surface pressure is generated around the contact point 292 close to the seal member 600, and the color in the drawing is darker. That is, it is understood that the lower half flange surface 210 and the upper half flange surface 310 come into contact with each other around the seal member 600. In this way, the lower half inclined surface 290 is formed, and thus, it is understood that it is possible to prevent a gap from being generated around the seal member 600.

In addition, in one or more embodiments, only the lower half inclined surface 290 is formed. That is, in the upper half casing 300, the upper half inclined surface corresponding to the lower half inclined surface 290 of the lower half casing 200 is not formed between the upper half flange surface 310 and the upper half step surface 353. Accordingly, it is possible to suppress a gap from being generated around the seal member 600 by machining only the lower half casing 200 which is more easily machined than the upper half casing 300.

In addition, the lower half inclined surface 290 is formed closer to the lower half large-diameter recessed portion 251 than the imaginary line 293 which connects the point closest to the lower half large-diameter recessed portion 251 in the axial direction Da in the contact points 292 on the inner peripheral surface of the lower half small-diameter recessed portion 252 with which the seal member 600 is in contact and the outermost point 291 to each other. The lower half inclined surface 290 is in non-contact with the upper half flange surface 310, and thus, a boundary between the lower half inclined surface 290 and the lower half flange surface 210 comes into contact with the upper half flange surface 310. Accordingly, a high surface pressure is generated in the boundary. The lower half inclined surface 290 is formed closer to the lower half large-diameter recessed portion 251 than the imaginary line 293, and thus, the boundary can be formed closer to the lower half large-diameter recessed portion 251 than the contact point 292 with which the seal member 600 is in contact. Accordingly, the periphery of the contact point 292 with which the seal member 600 is in contact can come into easy contact with the upper half flange surface 310. As a result, it is possible to suppress a gap from being generated around the seal member 600, with high accuracy. Therefore, it is possible to suppress leakage of the process gas from the portion between the outer peripheral surface of the housing 500 and the upper half casing 300 and the portion between the outer peripheral surface and the lower half casing 200, with higher accuracy.

In addition, the boundary between the lower half inclined surface 290 and the lower half flange surface 210 coincides with the imaginary line 293, and thus, the periphery of the contact point 292 with which the seal member 600 is in contact can come into reliable contact with the upper half flange surface 310. As a result, it is possible to suppress a gap from being generated around the seal member 600, with high accuracy.

Therefore, the centrifugal compressor 1 has the casing assembly 100, and thus, it is possible to prevent leakage of a high-pressure fluid such as a working fluid flowing through the inside of the centrifugal compressor 1, with high accuracy.

Hereinbefore, the embodiment of the present invention is described in detail with reference to the drawings. However, the configurations and combinations thereof in the embodiment are merely examples, and additions, omissions, substitutions, and other modifications of the configurations are possible within the scope which does not depart from the gist of the present invention. In addition, the present invention is not limited by the embodiment and is limited only by claims.

Moreover, in the casing assembly 100 of the above-described embodiment, the upper half casing 300 does not have the upper half inclined surface and only the lower half casing 200 has the lower half inclined surface 290. However, the present invention is not limited to this structure. The casing assembly 100 may have at least one of the lower half inclined surface 290 and the upper half inclined surface, may have both the lower half inclined surface 290 and the upper half inclined surface, or may have only the upper half inclined surface.

In addition, in one or more embodiments, the centrifugal compressor 1 is described as an example of the rotary machine. However, the present invention is not limited to this. For example, the rotary machine may be a turbocharger or a pump.

According to the casing assembly 100 and the rotary machine, it is possible to suppress the leakage of the working fluid from the portion between the outer peripheral surface of the housing 500 and the upper half casing 300 and the portion between the outer peripheral surface and the lower half casing 200, with high accuracy.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1: centrifugal compressor
O: axis
Da: axial direction
Dr: radial direction
Dv: vertical direction
Dw: width direction
2: rotor
3: rotor body
4: impeller
4*a*: disk
4*b*: blade
4*c*: cover
5: diaphragm group
51: diaphragm
52: suction port
53: suction flow path
54: diffuser flow path
55: curved flow path
56: return flow path
57: discharge flow path
58: discharge port
6: seal device
100: casing assembly
200: lower half casing
210: lower half flange surface
211: first lower half flange surface
212: second lower half flange surface
250: lower half accommodation recessed portion
251: lower half large-diameter recessed portion
251*a*: lower half corner region
252: lower half small-diameter recessed portion
253: lower half step surface
290: lower half inclined surface
291: outermost point
292: contact point
293: imaginary line
300: upper half casing
310: upper half flange surface
311: first upper half flange surface
312: second upper half flange surface
350: upper half accommodation recessed portion
351: upper half large-diameter recessed portion
351*a*: upper half corner region
352: upper half small-diameter recessed portion
353: upper half step surface
101: casing
400: fixing portion
401: fixing hole
402: through-hole
500: housing
600: seal member

What is claimed is:

1. A casing assembly into which a rotor rotatable around an axis is inserted, comprising:

a lower half casing comprising:
- a horizontal, lower half flange surface facing upward in a vertical direction; and
- a lower half accommodation recessed portion recessed downward in the vertical direction from the lower half flange surface;

an upper half casing comprising:
- an upper half flange surface that contacts the lower half flange surface; and
- an upper half accommodation recessed portion recessed upward from the lower half flange surface;

a fixing portion that fixes the lower half casing and the upper half casing to each other such that, when the lower half flange surface and the upper half flange surface make contact, the lower half accommodation recessed portion and the upper half accommodation recessed portion form an accommodation space extending about the axis;

a housing disposed in the accommodation space; and a seal member disposed on an outer peripheral surface of the housing and in contact with an inner peripheral surface of the lower half accommodation recessed portion and an inner peripheral surface of the upper half accommodation recessed portion, wherein the lower half accommodation recessed portion includes:
- a lower half large-diameter recessed portion extending in an axial direction in which the axis extends;
- a lower half small-diameter recessed portion adjacent to the lower half large-diameter recessed portion in the axial direction and that is smaller in size, in a radial direction intersecting the axis, than the lower half large-diameter recessed portion; and
- a lower half step surface between the lower half large-diameter recessed portion and the lower half small-diameter recessed portion and that spreads in the radial direction, wherein the upper half accommodation recessed portion includes:
- an upper half large-diameter recessed portion extending in the axial direction;
- an upper half small-diameter recessed portion adjacent to the upper half large-diameter recessed portion in the axial direction and that is smaller in size, in the radial direction, than the upper half large-diameter recessed portion; and
- an upper half step surface between the upper half large-diameter recessed portion and the upper half small-diameter recessed portion and that spreads in the radial direction, and wherein the casing assembly has at least one of:
- a lower half inclined surface between the lower half flange surface and the lower half step surface and that is inclined downward from the lower half flange surface toward the lower half step surface, and
- an upper half inclined surface between the upper half flange surface and the upper half step surface and that is inclined upward from the upper half flange surface toward the upper half step surface.

2. The casing assembly according to claim 1, wherein the casing assembly has the lower half inclined surface but not the upper half inclined surface.

3. The casing assembly according to claim 2, wherein, when viewed from above in the vertical direction, the lower half large-diameter recessed portion has a corner region on a side adjacent to the lower half small-diameter recessed portion in the axial direction and outside the lower half small-diameter recessed portion in the radial direction, and wherein, when viewed from above in the vertical direction, the lower half inclined surface is closer to the lower half large-diameter recessed portion than an imaginary line that connects an outermost point on a side closest to the lower half small-diameter recessed portion in the axial direction in the corner region and a contact point of an inner peripheral surface of the lower half small-diameter recessed portion with which the seal member is in contact.

4. A rotary machine, comprising:

the casing assembly according to claim 1; and a rotor disposed in the casing assembly.

* * * * *